US011318736B2

(12) United States Patent
Fujisawa et al.

(10) Patent No.: US 11,318,736 B2
(45) Date of Patent: May 3, 2022

(54) LIQUID EJECTING APPARATUS, DRIVE CIRCUIT, AND INTEGRATED CIRCUIT

(71) Applicant: Seiko Epson Corporation, Tokyo (JP)

(72) Inventors: Kazuhito Fujisawa, Minowa (JP); Atsushi Obinata, Shiojiri (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 17/036,243

(22) Filed: Sep. 29, 2020

(65) Prior Publication Data

US 2021/0094285 A1 Apr. 1, 2021

(30) Foreign Application Priority Data

Sep. 30, 2019 (JP) ..... JP2019-179215

(51) Int. Cl.
*B41J 2/045* (2006.01)

(52) U.S. Cl.
CPC ..... *B41J 2/04541* (2013.01); *B41J 2/04586* (2013.01)

(58) Field of Classification Search
CPC . B41J 2/04541; B41J 2/04586; B41J 2/04581
See application file for complete search history.

(56) References Cited

U.S. PATENT DOCUMENTS 10,160,202 B2 * 12/2018 Ito ..... B41J 2/15
10,265,952 B2 * 4/2019 Shimono ..... B41J 25/34
10,457,041 B2 * 10/2019 Yamada ..... B41J 2/04596

FOREIGN PATENT DOCUMENTS

JP 2018-099866 A 6/2018

* cited by examiner

*Primary Examiner* — Lam S Nguyen
(74) *Attorney, Agent, or Firm* — Harness, Dickey & Pierce, P.L.C.

(57) ABSTRACT

A liquid ejecting apparatus includes a differential signal output circuit that outputs a pair of differential signals based on an original control signal, a pair of first signal wirings that are electrically coupled to the differential signal output circuit and propagate the differential signals, a first receiving circuit that is electrically coupled to the first signal wirings, a second receiving circuit that is electrically coupled to the first signal wirings, and an ejector that includes a drive element and that ejects a liquid from a nozzle by driving the drive element, in which the first receiving circuit outputs a control signal for controlling driving of the drive element based on the differential signals, power consumption of the first receiving circuit is larger than power consumption of the second receiving circuit, and the first receiving circuit and the second receiving circuit are electrically coupled by a second signal wiring.

10 Claims, 10 Drawing Sheets

| | | LARGE DOT | MEDIUM DOT | SMALL DOT | SLIGHT VIBRATION |
|---|---|---|---|---|---|
| [SIH, SIL] | | [1, 1] | [1, 0] | [0, 1] | [0, 0] |
| S | T1 | H | H | L | L |
| | T2 | H | L | H | L |
| | T3 | L | L | L | H |

LIQUID EJECTING APPARATUS, DRIVE CIRCUIT, AND INTEGRATED CIRCUIT

The present application is based on, and claims priority from JP Application Serial Number 2019-179215, filed Sep. 30, 2019, the disclosure of which is hereby incorporated by reference herein in its entirety.

BACKGROUND

1. Technical Field

The present disclosure relates to a liquid ejecting apparatus, a drive circuit, and an integrated circuit.

2. Related Art

As an ink jet printer (liquid ejecting apparatus) that prints an image or a document by ejecting ink as a liquid, an apparatus using a piezoelectric element as a drive element such as a piezo element is known. In such an ink jet printer, the piezoelectric element is provided for each of a plurality of nozzles in a print head. When a drive signal is supplied to the piezoelectric elements at a predetermined timing, each piezoelectric element is driven, a predetermined amount of ink is ejected from nozzles, and an image or a document is formed on a print medium.

In order to meet the demand for further improvement in printing accuracy in recent years, the number of nozzles of an ink jet printer has been increasing. Then, as the number of nozzles increases, the amount of data transferred to the print head increases. Therefore, as a technique for transferring the data to the print head at a high speed, a technique for transferring the data to the print head by a communication method using a differential signal such as low voltage differential signaling (LVDS) has been known.

For example, JP-A-2018-099866 discloses a liquid ejecting apparatus that converts various data for ejecting liquid into an LVDS differential signal, transfers the data to a head unit, restores the LVDS differential signal in a control signal receiving portion provided in the head unit, and controls various operations in the head unit based on the restored signal.

However, in the liquid ejecting apparatus described in JP-A-2018-099866, as an amount of data increases due to the increase in the number of nozzles, the power consumption of a control signal receiving portion that restores a differential signal increases, and as a result, the power consumption of the liquid ejecting apparatus may increase. That is, there is room for improvement in reducing power consumption in the liquid ejecting apparatus performs high-speed signal transmission using differential signals.

SUMMARY

According to an aspect of the present disclosure, there is provided a liquid ejecting apparatus including a differential signal output circuit that outputs a pair of differential signals based on an original control signal; a pair of first signal wirings that are electrically coupled to the differential signal output circuit and propagate the differential signals; a first receiving circuit that is electrically coupled to the first signal wirings; a second receiving circuit that is electrically coupled to the first signal wirings; and an ejector that includes a drive element and that ejects a liquid from a nozzle by driving the drive element, in which the first receiving circuit outputs a control signal for controlling driving of the drive element based on the differential signals, power consumption of the first receiving circuit is larger than power consumption of the second receiving circuit, and the first receiving circuit and the second receiving circuit are electrically coupled by a second signal wiring.

In the liquid ejecting apparatus, an operating frequency of the first receiving circuit may be higher than an operating frequency of the second receiving circuit.

In the liquid ejecting apparatus, a mounting area in which the first receiving circuit is mounted may be larger than a mounting area in which the second receiving circuit is mounted.

In the liquid ejecting apparatus, the first receiving circuit operates, when the drive element is driven.

In the liquid ejecting apparatus, the second receiving circuit operates, when the drive element is not driven.

In the liquid ejecting apparatus, the first receiving circuit stops operating, when the drive element is not driven.

According to another aspect of the present disclosure, there is a liquid ejecting apparatus including a drive signal output circuit that outputs a drive signal for driving the drive element; and a drive signal supply control circuit that controls supply of the drive signal to the drive element based on the control signal, in which the first receiving circuit, the second receiving circuit, and the drive signal supply control circuit may be integrated in one integrated circuit.

In the liquid ejecting apparatus, an ejecting head having a plurality of ejectors, in which the ejecting head is provided with a plurality of the nozzles corresponding to the plurality of ejectors in a total of 600 nozzles or more at a density of 300 nozzles or more per inch.

According to still another aspect of the present disclosure, there is a drive circuit that drives a drive element for ejecting a liquid from an ejector, the drive circuit including a differential signal output circuit that converts an original control signal into a pair of differential signals and outputs the pair of differential signals; a pair of first signal wirings that are electrically coupled to the differential signal output circuit and propagate the differential signals; a first receiving circuit that is electrically coupled to the first signal wirings; and a second receiving circuit that is electrically coupled to the first signal wirings, in which the first receiving circuit may output a control signal for controlling driving of the drive element based on the differential signals, power consumption of the first receiving circuit may be larger than power consumption of the second receiving circuit, and the first receiving circuit and the second receiving circuit may be electrically coupled by a second signal wiring.

According to still another aspect of the present disclosure, there is an integrated circuit that drives a drive element for ejecting a liquid from an ejector, the integrated circuit including a pair of input terminals to which a pair of differential signals are input; a first receiving circuit that is electrically coupled to the input terminal; and a second receiving circuit that is electrically coupled to the input terminal, in which the first receiving circuit outputs a control signal for controlling driving of the drive element based on the differential signals, power consumption of the first receiving circuit is larger than power consumption of the second receiving circuit, and the first receiving circuit and the second receiving circuit are electrically coupled by a second signal wiring.

DESCRIPTION OF EXEMPLARY EMBODIMENTS

Hereinafter, preferred embodiments of the present disclosure will be described with reference to drawings. The drawings to be used are for convenience of description. The embodiments described below do not unduly limit the contents of the present disclosure described in the claims. In addition, all of the configurations described below are not necessarily essential components of the present disclosure.

1. Configuration of Liquid Ejecting Apparatus

Figure 1:
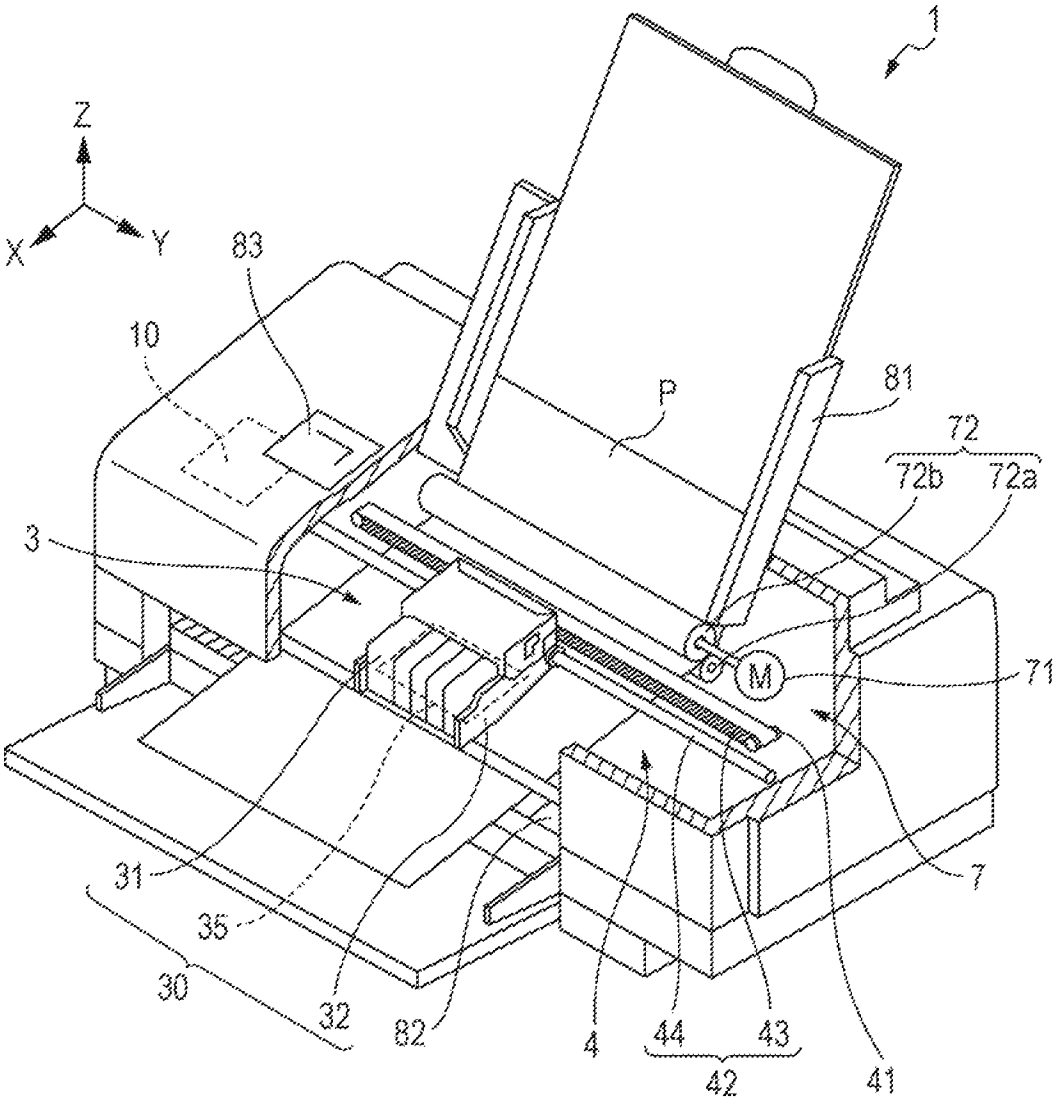
FIG. 1 is a view schematically illustrating a configuration of a liquid ejecting apparatus.

A configuration of a liquid ejecting apparatus 1 will be described. FIG. 1 is a view schematically illustrating the configuration of the liquid ejecting apparatus 1. FIG. 1 illustrates an X direction, a Y direction, and a Z direction that are orthogonal to each other. In the following description, the upper side corresponding to the +Z direction in FIG. 1 may be referred to as "upper", and the lower side corresponding to the −Z direction may be referred to as "lower".

The liquid ejecting apparatus 1 is provided with a tray 81 for installing a medium P at the upper rear, a paper outlet 82 for discharging the medium P at the lower front, and an operation panel 83 on the upper surface. The operation panel 83 is configured by, for example, a liquid crystal display, an organic EL display, an LED lamp, and the like, and includes an unillustrated display portion that displays an error message and the like, and an operation portion (not illustrated) for inputting various operations by a user.

In addition, the liquid ejecting apparatus 1 includes a printing unit 4 having a reciprocating moving object 3.

The moving object 3 includes a head unit 30. The head unit 30 also includes a plurality of ink cartridges 31, a carriage 32 on which the plurality of ink cartridges 31 are mounted, and a plurality of print heads 35 attached on the −Z direction side of the carriage 32. The plurality of print heads 35 are provided corresponding to the plurality of ink cartridges 31.

Each ink cartridge 31 is filled with ink as an example of liquids corresponding to ink colors such as yellow, cyan, magenta, and black. The ink filled in the ink cartridge 31 is applied to the corresponding print head 35. Then, each print head 35 ejects the ink supplied from the corresponding ink cartridge 31. Each ink cartridge 31 may be provided at another location of the liquid ejecting apparatus 1 instead of being mounted on the carriage 32.

The printing unit 4 includes a carriage motor 41 serving as a drive source for moving the moving object 3 forward and backward along the Y direction which is the main scanning direction, and a reciprocating mechanism 42 for moving the moving object 3 forward and backward by the rotating operation of the carriage motor 41. The reciprocating mechanism 42 has a carriage guide shaft 44 whose both ends are supported by a frame (not illustrated), and a timing belt 43 extending in parallel with the carriage guide shaft 44. The carriage 32 is movably supported forward and backward by the carriage guide shaft 44 and is fixed to a part of the timing belt 43. The moving object 3 is guided by the carriage guide shaft 44 and reciprocates by causing the timing belt 43 to travel forward and backward through the pulleys by the operation of the carriage motor 41.

In addition, the liquid ejecting apparatus 1 includes a paper feeding device 7 for supplying and discharging the medium P to and from the printing unit 4. The paper feeding device 7 includes a paper feeding motor 71 serving as a drive source, and a paper feeding roller 72 that is rotated by the operation of the paper feeding motor 71. The paper feeding roller 72 includes a driven roller 72*a* facing up and down with the medium P interposed in the transport path of the medium P and a drive roller 72*b*. Here, the drive roller 72*b* is connected to the paper feeding motor 71. Thus, the paper feeding roller 72 feeds a plurality of media P set on the tray 81 one by one toward the printing unit 4 and discharges one by one from the printing unit 4. The liquid ejecting apparatus 1 may have a configuration in which a paper feeding cassette that accommodates the medium P may be detachably mounted instead of the tray 81.

Further, the liquid ejecting apparatus 1 includes a control unit 10 that controls the printing unit 4 and the paper feeding device 7. The control unit 10 performs printing processing on the medium P by controlling the printing unit 4 and the paper feeding device 7 based on image data input from a host computer such as a personal computer or a digital camera.

Specifically, the control unit 10 controls the paper feeding device 7 to intermittently feed the media P one by one in the sub-scanning direction, which is the X direction. The control unit 10 controls the moving object 3 to reciprocate in the main scanning direction, which is the Y direction intersecting the sub-scanning direction. That is, the control unit 10 controls the moving object 3 to reciprocate in the main scanning direction and controls the paper feeding device 7 to intermittently feed the medium P in the sub-scanning direction. Further, the control unit 10 executes printing processing on the medium P by controlling the ejection timing of the ink from the print head 35 based on the input image data. Further, the control unit 10 may display an error message or the like on the display portion of the operation panel 83 or turns on/off an LED lamp or the like, and may cause each unit to execute corresponding processing based on pressing signals of various switches input from the operation portion of the operation panel 83, or may execute processing of transferring information such as an error message and discharge abnormality to the host computer as needed. Here, a part of the control unit 10 may be mounted on the carriage 32.

In the liquid ejecting apparatus 1 configured as described above, the control unit 10 controls the transport of the medium P and the reciprocating movement of the carriage 32, and ejects the ink from the print head 35 at a predetermined timing to land the ink at a desired position on the medium P. Thereby, the liquid ejecting apparatus 1 forms a desired image on the medium P.

2. Configuration of Print Head

Figure 2:
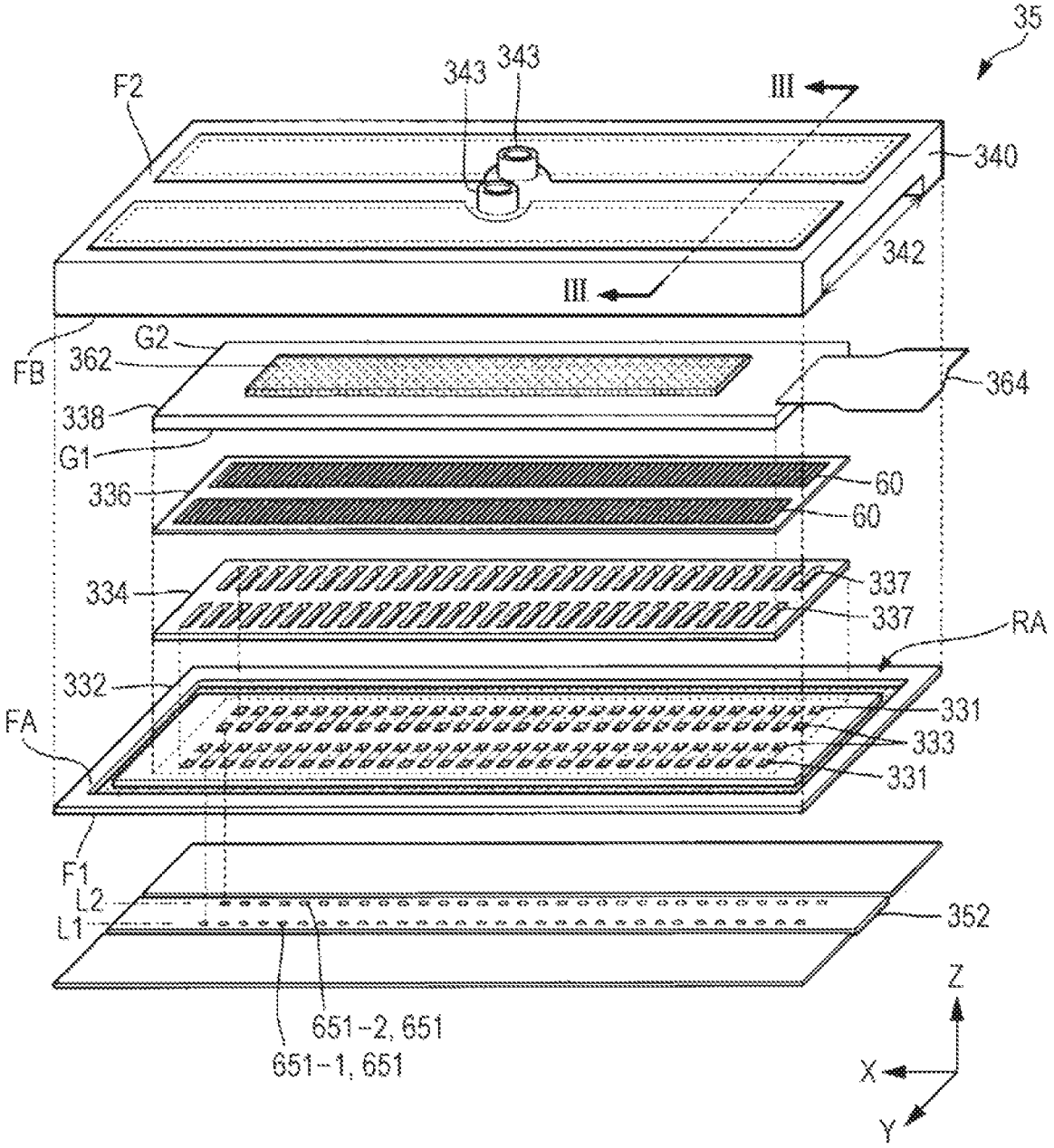
FIG. 2 is an exploded perspective view of a print head.
Figure 3:
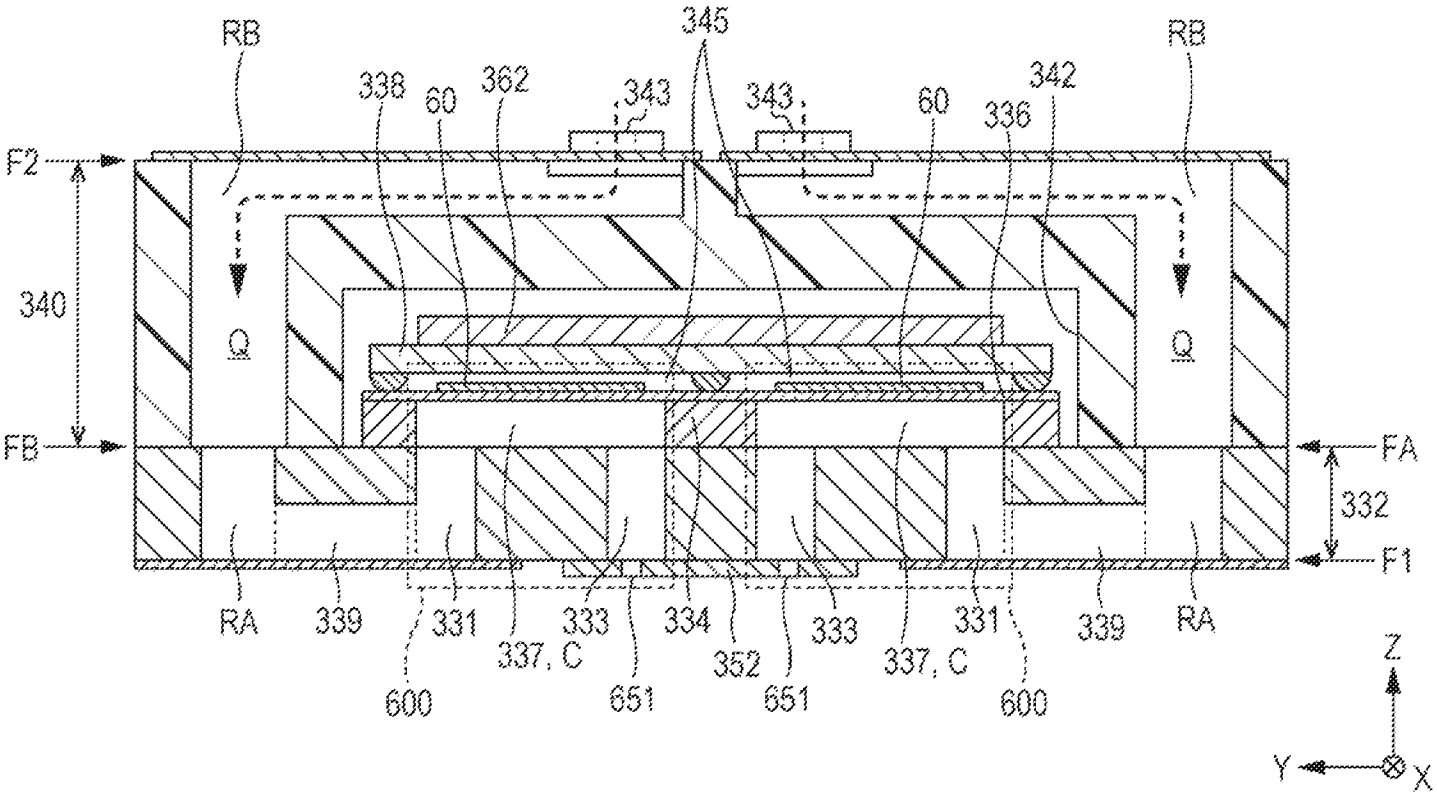
FIG. 3 is a sectional view illustrating a cross-section of the print head taken along the line III-III in FIG. 2.

Next, the configuration of the print head 35 included in the head unit 30 will be described. FIG. 2 is an exploded perspective view of the print head 35. FIG. 3 is a sectional view illustrating a cross-section of the print head 35 taken along the line III-III in FIG. 2.

As illustrated in FIG. 2, the print head 35 includes 2m nozzles 651 arranged in the X direction. In the present embodiment, the 2m nozzles 651 are arranged in two rows, row L1 and row L2. In the following description, each of the m nozzles 651 belonging to a row L1 may be referred to as a nozzle 651-1, and each of the m nozzles 651 belonging to a row L2 may be referred to as a nozzle 651-2. In the following description, it is assumed that the position of an i-th (i is a natural number satisfying $1 \leq i \leq m$) nozzle N651-1 in the X direction among the m nozzles 651-1 belonging to the row L1 substantially coincides with the position of an i-th nozzle 651-2 among the m nozzles 651-2 belonging to the row L2. Here, the term "substantially coincides" includes not only a case where the positions completely coincide each other but also a case where positions can be regarded as the same in consideration of an error. The 2m nozzles 651 may be arranged in a so-called staggered manner in which the i-th nozzle 651-1 among the m nozzles 651-1 belonging to the row L1 and the i-th nozzle 651-2 among the m nozzles 651-2 belonging to the row L2 have different positions in the X direction.

As illustrated in FIGS. 2 and 3, the print head 35 includes a channel substrate 332. The channel substrate 332 is a plate-shaped member including a surface F1 and a surface FA. The surface F1 is a surface on the medium P side as viewed from the print head 35, and the surface FA is a surface on the opposite side to the surface F1. A pressure chamber substrate 334, an actuator substrate 336, a plurality of piezoelectric elements 60, a wiring substrate 338, and a housing 340 are provided on a surface FA. A nozzle plate 352 is provided on the surface F1. Schematically, each element of the print head 35 is a plate-shaped member that is generally long in the X direction and is stacked in the Z direction.

The nozzle plate 352 is a plate-shaped member, and the nozzle plate 352 is formed with the 2m nozzles 651 as through holes. In the following description, the nozzles 651 corresponding to each of the rows L1 and L2 are provided at a density of 300 or more per inch on the nozzle plate 352, and a total of 600 or more nozzles 651 are formed on the nozzle plate 352. In other words, the print head 35 includes a plurality of ejectors 600, and the print head 35 is provided with a plurality of nozzles 651 corresponding to the plurality of ejectors 600 in a total of 600 or more with a density of 300 or more per inch. Here, any of the plurality of print heads 35 is an example of an ejecting head. In the following description, a surface of the nozzle plate 352 that is located outside the print head 35 and faces the medium P may be referred to as a nozzle surface.

The channel substrate 332 is a plate-shaped member for forming a channel for ink. As illustrated in FIGS. 2 and 3, a channel RA is formed in the channel substrate 332. In the channel substrate 332, 2m channels 331 and 2m channels 333 are formed so as to correspond to the 2m nozzles 651 on a one-to-one basis. The channel 331 and the channel 333 are openings formed to penetrate the channel substrate 332 as illustrated in FIG. 3. The channel 333 communicates with the nozzle 651 corresponding to the channel 333. In addition, two channels 339 are formed on the surface F1 of the channel substrate 332. One of the two channels 339 is a channel that connects the channel RA and the m channels 331 corresponding to the m nozzles 651-1 belonging to the row L1 on a one-to-one basis, and the other of the two channels 339 is a channel that connects the channel RA and the 2m channels 331 corresponding to the m nozzles 651-2 belonging to the row L2 on a one-to-one basis.

As illustrated in FIGS. 2 and 3, the pressure chamber substrate 334 is a plate-shaped member in which 2m openings 337 are formed so as to correspond to the 2m nozzles 651 on a one-to-one basis. The actuator substrate 336 is provided on the surface of the pressure chamber substrate 334 opposite to the channel substrate 332.

As illustrated in FIG. 3, the actuator substrate 336 and the surface FA of the channel substrate 332 face each other at an interval inside each opening 337. The space located between the surface FA of the channel substrate 332 and the actuator substrate 336 inside the opening 337 functions as a cavity C for applying pressure to the ink filled in the space. The cavity C is, for example, a space having the Y direction as a longitudinal direction and the X direction as a lateral direction. The print head 35 is provided with 2m cavities C so as to correspond to the 2m nozzles 651 on a one-to-one basis. The cavity C provided corresponding to the nozzle 651-1 communicates with the channel RA via the channel 331 and the channel 339 and communicates with the nozzle 651-1 via the channel 333. Further, the cavity C provided corresponding to the nozzle 651-2 communicates with the channel RA via the channel 331 and the channel 339 and communicates with the nozzle 651-2 via the channel 333.

As illustrated in FIGS. 2 and 3, on the surface of the actuator substrate 336 opposite to the cavity C, 2m piezoelectric elements 60 are provided so as to correspond to 2m cavities C on a one-to-one basis. A drive signal VOUT described later is supplied to the piezoelectric element 60. Then, the piezoelectric element 60 is driven according to the supplied drive signal VOUT. The actuator substrate 336 deforms as the piezoelectric element 60 is driven. Then, due to the deformation of the actuator substrate 336, the internal pressure of the cavity C fluctuates, and the ink filled in the cavity C is ejected from the nozzle 651 via the channel 333.

The configuration including the cavity C, the channels 331 and 333, the nozzle 651, the actuator substrate 336, and the piezoelectric element 60 functions as the ejector 600 for ejecting the ink filled in the cavity C by driving the piezoelectric element 60. In other words, the ejector 600 includes the piezoelectric element 60 as an example of a drive element, and the ink is ejected from the nozzle 651 by driving the piezoelectric element 60. In the print head 35, the plurality of ejectors 600 corresponding to the plurality of nozzles 651 along the X direction are arranged side by side in two rows corresponding to the rows L1 and L2.

The wiring substrate 338 illustrated in FIGS. 2 and 3 includes a surface G1 and a surface G2 facing the surface G1. Two accommodation spaces 345 are formed on the surface G1 of the wiring substrate 338, which is the surface on the medium P side as viewed from the print head 35. One of the two accommodation spaces 345 is a space for accommodating the m piezoelectric elements 60 corresponding to the m nozzles 651-1, and the other is a space for accommodating m piezoelectric elements 60 corresponding to the m nozzles 651-2. When the piezoelectric element 60 is driven, the height of the accommodation space 345, which is the width in the Z direction, is sufficiently large so that the piezoelectric element 60 and the wiring substrate 338 do not come into contact with each other.

An integrated circuit 362 is provided on a surface G2 of the wiring substrate 338, which is a surface opposite to the surface G1. Then, the signal input to the integrated circuit 362 and the signal output from the integrated circuit 362 propagate through the wiring substrate 338.

Further, one end of a coupling wiring 364 is electrically coupled to the wiring substrate 338. The other end of the coupling wiring 364 is coupled to a wiring substrate (not illustrated) of the print head 35. The plurality of signals input to the print head 35 are input to the print head 35 via the coupling wiring 364 after being propagated through the wiring substrate. That is, the coupling wiring 364 is a member in which a plurality of wirings for transferring various signals to the integrated circuit 362 are formed, and is formed of, for example, a flexible printed circuit (FPC) or a flexible flat cable (FFC).

The housing 340 is a case for storing the ink supplied to the 2m cavities C. A surface FB of the housing 340, which is the surface on the medium P side when viewed from the print head 35, is fixed to the surface FA of the channel substrate 332 with an adhesive, for example. A groove-shaped recess 342 extending in the Y direction is formed on the surface FB of the housing 340. The wiring substrate 338 and the integrated circuit 362 are accommodated inside the recess 342. At this time, the coupling wiring 364 is provided so as to pass through the inside of the recess 342.

The housing 340 is formed by injection molding of a resin material, for example. Then, as illustrated in FIG. 3, a channel RB communicating with the channel RA is formed in the housing 340. The channel RA and the channel RB function as a reservoir Q that stores the ink supplied to the 2m cavities C.

Two inlets 343 for introducing the ink supplied from the ink cartridge 31 into the reservoir Q are provided on the surface F2, which is the surface opposite to the surface FB of the housing 340. The ink supplied from the ink cartridge 31 to the two inlets 343 flows into the channel RA via the channel RB. Then, a part of the ink flowing into the channel RA is supplied to the cavity C corresponding to the nozzle 651 via the channel 339 and the channel 331. Then, the ink filled in the cavity C corresponding to the nozzle 651 is ejected from the nozzle 651 by driving the piezoelectric element 60 corresponding to the nozzle 651.

3. Electrical Configuration and Operation of Control Unit and Print Head

Next, various signals supplied from the control unit 10 to the head unit 30 and the electrical configurations of the control unit 10 and the head unit 30 in the liquid ejecting apparatus 1 configured as described above will be described.

Figure 4:
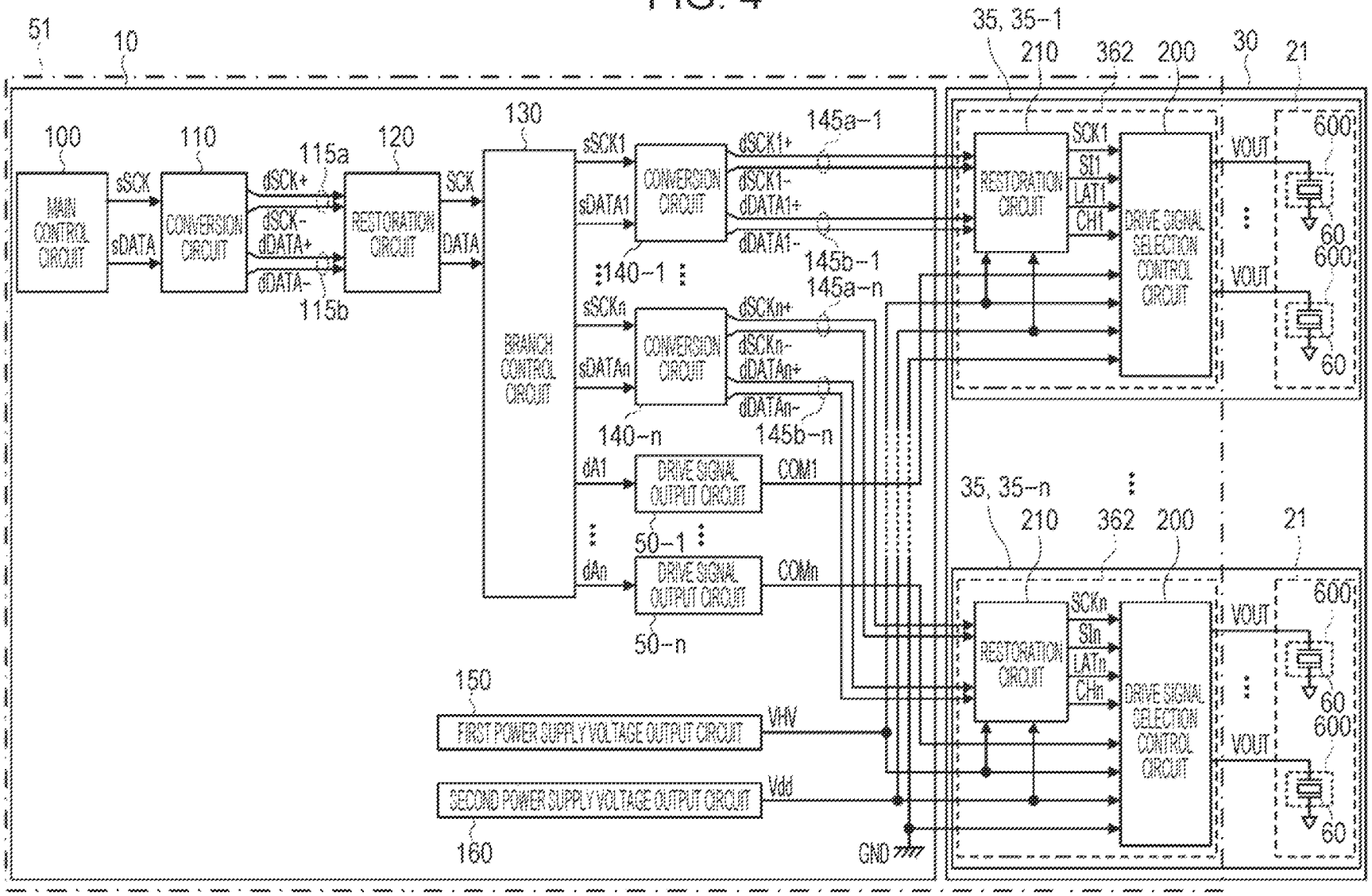
FIG. 4 is a view illustrating an electrical configuration of a control unit and a head unit in the liquid ejecting apparatus.

FIG. 4 is a view illustrating an electrical configuration of the control unit 10 and the head unit 30 in the liquid ejecting apparatus 1. As illustrated in FIG. 4, the liquid ejecting apparatus 1 includes the control unit 10 and the head unit 30, and various signals propagate between the control unit 10 and the head unit 30. The control unit 10 includes a main control circuit 100, a conversion circuit 110, a restoration circuit 120, a branch control circuit 130, conversion circuits 140-1 to 140-*n*, drive signal output circuits 50-1 to 50-*n*, a first power supply voltage output circuit 150, and a second power supply voltage output circuit 160. The head unit 30 also includes print heads 35-1 to 35-*n*. In each of the conversion circuits 140-1 to 140-*n* and the drive signal output circuits 50-1 to 50-*n* included in the control unit 10, the head unit 30 corresponds to each of the print heads 35-1 to 35-*n*. Specifically, an j-th (j is a natural number satisfying $1 \leq j \leq n$) conversion circuit 140-*j* and drive signal output circuit 50-*j* are provided corresponding to a print head 35-*j*.

The main control circuit 100 includes, for example, a processor such as a microcontroller. Then, the main control circuit 100 generates an original data signal sDATA and an original clock signal sSCK, which are single-ended signals for driving the print heads 35-1 to 35-*n* included in the head unit 30 based on various signals such as image data input from a host computer (not illustrated) provided outside the liquid ejecting apparatus 1, and outputs the same to the conversion circuit 110. That is, the original data signal sDATA includes drive data corresponding to each of the print heads 35-1 to 35-*n*, and the original clock signal sSCK includes clock signals corresponding to each of the n print heads 35.

The conversion circuit 110 converts each of the input original data signal sDATA and the original clock signal sSCK, which are single-ended signals, into a differential signal. Specifically, the conversion circuit 110 converts the original data signal sDATA, which is a single-ended signal, into a pair of differential data signals dDATA. That is, the differential data signal dDATA includes drive data corresponding to each of the print heads 35-1 to 35-*n*. Then, the pair of differential data signals dDATA converted by the conversion circuit 110 propagates through the pair of wirings 115*a* and is input to the restoration circuit 120. Similarly, the conversion circuit 110 converts the original clock signal sSCK, which is a single-ended signal, into a pair of differential clock signals dSCK. The differential clock signal dSCK includes a clock signal corresponding to each of the print heads 35-1 to 35-*n*. Then, the pair of differential clock signals dSCK converted by the conversion circuit 110 propagates through a pair of wirings 115*b* and is input to the restoration circuit 120.

Here, in FIG. 4, one signal of the pair of differential data signals dDATA is illustrated as a differential data signal dDATA+, and the other signal of the pair of differential data signals dDATA is illustrated as a differential data signal dDATA−. Similarly, one signal of the pair of differential clock signals dSCK is illustrated as a differential clock signal dSCK+, and the other signal of the pair of differential clock signals dSCK is illustrated as a differential clock signal dSCK−.

The restoration circuit 120 restores the input pair of differential data signals dDATA to a data signal DATA which is a single-ended signal. Further, the restoration circuit 120 restores the input pair of differential clock signals dSCK to a clock signal SCK which is a single-ended signal. Here, the data signal DATA which is the single-ended signal restored by the restoration circuit 120 is a signal according to the original data signal sDATA output from the main control circuit 100, and may be the same signal. Similarly, the clock signal SCK which is the single-ended signal restored by the restoration circuit 120 is a signal according to the original clock signal sSCK output from the main control circuit 100, and may be the same signal. That is, the data signal DATA is a single-ended signal including drive data corresponding to each of the print heads 35-1 to 35-*n*, and the clock signal SCK is a single-ended signal including a clock signal corresponding to each of the print heads 35-1 to 35-*n*. Then, the data signal DATA and the clock signal SCK restored by the restoration circuit 120 are input to the branch control circuit 130.

The branch control circuit 130 branches the data signal DATA and the clock signal SCK input from the restoration circuit 120 into signals corresponding to the print heads 35-1 to 35-*n* and outputs the same.

Specifically, the branch control circuit 130 outputs the original data signal sDATAj and the original clock signal sSCKj, which are single-ended signals for driving the print head 35-*j*, to the conversion circuit 140-*j* corresponding to the print head 35-*j*.

The conversion circuit 140-*j* converts the original data signal sDATAj which is a single-ended signal into a pair of differential data signals dDATAj and converts the original clock signal sSCKj which is a single-ended signal into a pair of differential clock signals dSCKj. Then, the pair of differential data signals dDATAj converted by the conversion circuit 140-*j* propagates through a pair of wirings 145*a*-*j* and are input to a restoration circuit 210 included in the print head 35-*j*, and the pair of differential clock signals dSCKj propagate through the pair of wirings 145*b*-*j* and are input to the restoration circuit 210 included in the print head 35-*j*.

Here, the original data signal sDATAj is an example of an original control signal, and the pair of differential data signals dDATAj is an example of a pair of differential signals. The conversion circuit 140-*j* that outputs the pair of differential data signals dDATAj based on the original data signal sDATAj is an example of a differential signal output circuit. The pair of wirings 145*b*-*j* electrically coupled to the conversion circuit 140-*j* and propagating the pair of differential data signals dDATAj are an example of a first signal wiring.

In FIG. 4, one signal of the pair of differential data signals dDATAj is illustrated as a differential data signal dDATAj+, and the other signal of the pair of differential data signals dDATAj is illustrated as a differential data signal dDATAj−. Similarly, one signal of the pair of differential clock signals dSCKj is illustrated as a differential clock signal dSCKj+, and the other signal of the pair of differential clock signals dSCKj is illustrated as a differential clock signal dSCKj−.

The branch control circuit 130 also generates a base drive signal dAj that is a base of the drive signal COMj for driving the piezoelectric element 60 included in the print head 35-*j* and outputs the same to the drive signal output circuit 50-*j* corresponding to the print head 35-*j*. The drive signal output circuit 50-*j* converts the input base drive signal dAj into a digital/analog signal, and generates and outputs a drive signal COMj by class-D amplifying the converted analog signal. The base drive signal dAj may be any signal as long as the signal can define the waveform of the drive signal COMj, and may be an analog signal. Further, a class-D amplifier circuit included in the drive signal output circuit 50-*j* only needs to be able to amplify a waveform defined by the base drive signal dAj, and may be configured by a class-A amplifier circuit, a class-B amplifier circuit, a class-AB amplifier circuit, or the like.

The first power supply voltage output circuit 150 generates a voltage VHV and outputs the same to the head unit 30. Further, the second power supply voltage output circuit 160 generates a voltage VDD and outputs the same to the head unit 30. The voltage VHV and the voltage VDD are used for various power supply voltages in the head unit 30. The voltage VHV and the voltage VDD may be used for various power supply voltages in the control unit 10 and the like.

Although not described in FIG. 4, the main control circuit 100 may generate a control signal for controlling various components of the liquid ejecting apparatus 1 and output the generated control signal to a corresponding component.

The print heads 35-1 to 35-*n* included in the head unit 30 are driven based on various control signals input from the control unit 10 to eject ink. The print head 35-*j* includes the integrated circuit 362 and a head 21. Further, the integrated circuit 362 includes a drive signal selection control circuit 200 and a restoration circuit 210. In other words, the drive signal selection control circuit 200 and the restoration circuit 210 corresponding to the print head 35-*j* are integrated in one integrated circuit 362. The head 21 includes a plurality of ejectors 600.

The differential data signal dDATAj and the differential clock signal dSCKj are input to the restoration circuit 210 included in the print head 35-*j*. Then, the restoration circuit 210 generates a clock signal SCKj, a print data signal SIj, a latch signal LATj, and a change signal CHj based on the input differential data signal dDATAj and differential clock signal dSCKj and outputs the same to the drive signal selection control circuit 200.

The drive signal selection control circuit 200 included in the print head 35-*j* receives the voltages VHV and VDD, the clock signal SCKj, the print data signal SIj, the latch signal LATj, the change signal CHj, the drive signal COMj, and a ground signal GND. Then, the drive signal selection control circuit 200 included in the print head 35-*j* selects or deselects the signal waveform of the drive signal COMj based on the clock signal SCKj, the print data signal SIj, the latch signal LATj, and the change signal CHj to generate the drive signal VOUT and output the same to the head 21.

Each of the plurality of ejectors 600 included in the head 21 includes the piezoelectric element 60. Then, by supplying the drive signal VOUT to the piezoelectric element 60, the piezoelectric element 60 is driven, and the amount of ink due to the driving of the piezoelectric element 60 is ejected from the ejector 600. Here, in the print heads 35-*j*, the head 21 having a plurality of ejectors 600 is another example of the ejecting head.

In the liquid ejecting apparatus 1 configured as described above, the configuration including the restoration circuit 210 included in each of the main control circuit 100, the conversion circuit 110, the restoration circuit 120, the branch control circuit 130, the conversion circuits 140-1 to 140-*n*, the drive signal output circuits 50-1 to 50-*n*, and the print heads 35-1 to 35-*n* corresponds to the drive circuit 51 that drives the piezoelectric element 60 to eject ink from the plurality of ejectors 600 included in each of the print heads 35-1 to 35-*n*.

Here, the drive signal COMj output from the drive signal output circuit 50-*j* is an example of a drive signal. The drive signal VOUT generated by selecting or deselecting the waveform of the drive signal COMj and for driving the piezoelectric element 60 is also an example of a drive signal. The drive signal selection control circuit 200 that controls the supply of the drive signals COM and VOUT to the piezoelectric element 60 is an example of a drive signal supply control circuit, and at least one of the print data signal SIj, the latch signal LATj, and the change signal CHj input to the drive signal selection control circuit 200 for controlling the supply of the drive signals COM and VOUT to the piezoelectric element 60 is an example of a control signal.

4. Configuration and Operation of Integrated Circuit

Next, details of the integrated circuit 362 included in the print head 35-*j* will be described. As illustrated in FIG. 4, the integrated circuit 362 includes the drive signal selection control circuit 200 and the restoration circuit 210. In other words, the drive signal selection control circuit 200 and the restoration circuit 210 are integrated in one integrated circuit 362. Here, the terminal of the integrated circuit 362 to which the pair of differential data signals dDATAj is input is an example of the input terminal.

4.1. Example of Waveform of Drive Signal COM

In describing the details of the integrated circuit 362, an example of the waveform of the drive signal COMj input from the drive signal output circuit 50-*j* to the integrated circuit 362 included in the print head 35-*j* will be described.

Figure 5:
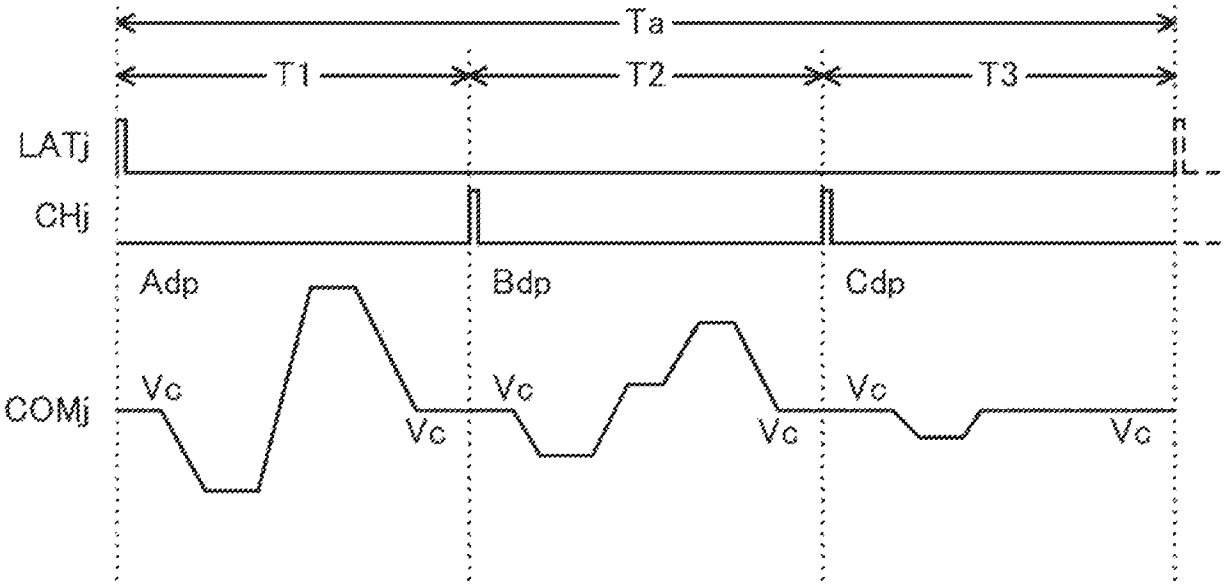
FIG. 5 is a view illustrating an example of a waveform of a drive signal COMj.

FIG. 5 is a view illustrating an example of a waveform of the drive signal COMj. In FIG. 5, a period T1 from the rise of the latch signal LATj to the rise of the change signal CHj, a period T2 from the period T1 to the next rise of the next change signal CHj, and a period T3 from the period T2 to the rise of the latch signal LATj are illustrated. A cycle Ta composed of the periods T1, T2, and T3 corresponds to a print cycle for forming a new dot on the medium P. That is, the latch signal LATj is a signal that defines the print cycle in which the print head 35-*j* forms a new dot on the medium P, and the change signal CHj is a signal that defines the switching timing of the waveform included in the drive signal COMj corresponding to the print head 35-*j*.

As illustrated in FIG. 5, the drive signal output circuit 50-*j* generates a trapezoidal waveform Adp in the period T1. When the trapezoidal waveform Adp is supplied to the piezoelectric element 60, a predetermined amount, specifically, a medium amount of ink is ejected from the corresponding ejector 600. The drive signal output circuit 50-*j* also generates a trapezoidal waveform Bdp in the period T2. When the trapezoidal waveform Bdp is supplied to the piezoelectric element 60, a small amount of ink smaller than the predetermined amount is ejected from the corresponding ejector 600. The drive signal output circuit 50-*j* also generates a trapezoidal waveform Cdp in the period T3. When the trapezoidal waveform Cdp is supplied to the piezoelectric element 60, the piezoelectric element 60 is driven to such an extent that ink is not ejected from the corresponding ejector 600. Therefore, when the trapezoidal waveform Cdp is supplied to the piezoelectric element 60, the print head 35-*j* does not form a dot on the medium P. The trapezoidal waveform Cdp is a waveform for preventing the viscosity of the ink from increasing by slightly vibrating the ink in the vicinity of the nozzle opening of the ejector 600. In the following description, driving the piezoelectric element 60 to such an extent that the ink is not ejected from the ejector 600 in order to prevent the viscosity of the ink from increasing may be referred to as "slight vibration".

Here, the voltage value at the start timing and the voltage value at the end timing of each of the trapezoidal waveform Adp, the trapezoidal waveform Bdp, and the trapezoidal waveform Cdp are common to a voltage Vc. That is, the trapezoidal waveforms Adp, Bdp, and Cdp are waveforms whose voltage values start at the voltage Vc and complete at the voltage Vc. As described above, the drive signal output circuit 50-*j* outputs the drive signal COMj having a waveform in which the trapezoidal waveforms Adp, Bdp, and Cdp are continuous in the cycle Ta. The waveform of the drive signal COMj illustrated in FIG. 5 is an example, and the present disclosure is not limited thereto. The drive signals COM1 to COMn output from the drive signal output circuits 50-1 to 50-*n* may have different waveforms.

4.2. Configuration of Drive Signal Selection Control Circuit

Figure 6:
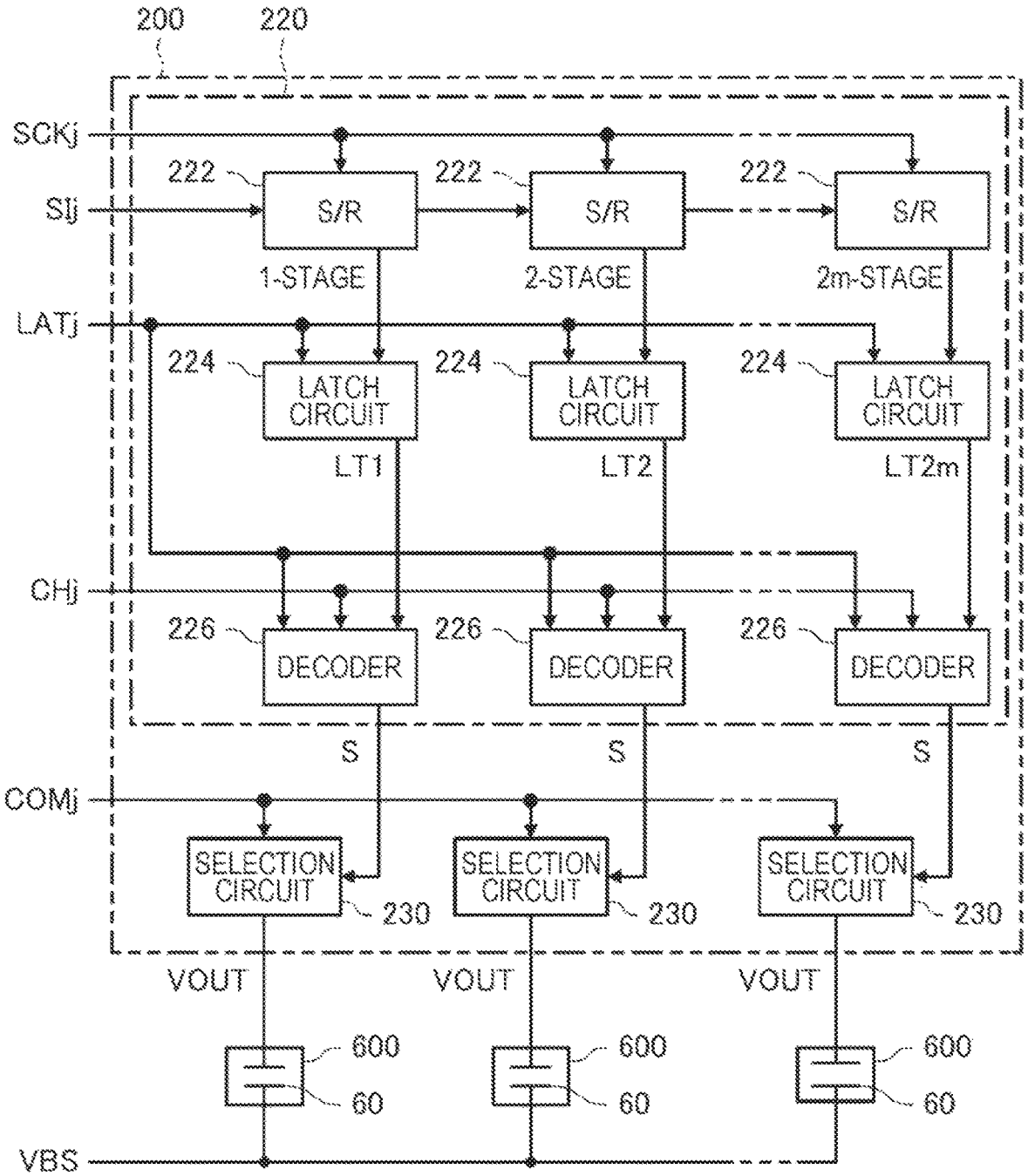
FIG. 6 is a view illustrating a configuration of a drive signal selection control circuit.

Next, the configuration and operation of the drive signal selection control circuit 200 integrated in the integrated circuit 362 included in the print head 35-*j* will be described. FIG. 6 is a view illustrating the configuration of the drive signal selection control circuit 200. The drive signal selection control circuit 200 switches between selecting and deselecting the trapezoidal waveforms Adp, Bdp, and Cdp included in the drive signal COMj in each of the periods T1, T2, and T3 to generate and output the drive signal VOUT supplied to the piezoelectric element 60 in the cycle Ta.

As illustrated in FIG. 6, the drive signal selection control circuit 200 includes a selection control circuit 220 and a plurality of selection circuits 230. The selection control circuit 220 is supplied with the clock signal SCKj, the print data signal SIj, the latch signal LATj, and the change signal CHj. The selection control circuit 220 is provided with a set of a shift register 222 (S/R), a latch circuit 224, and a decoder 226 corresponding to each of the ejectors 600. That is, the selection control circuit 220 is provided with the same number of sets of shift registers 222, latch circuits 224, and decoders 226 as the 2m ejectors 600 included in the print head 35-*j*.

The shift register 222 temporarily holds 2-bit print data [SIH, SIL] included in the print data signal SIj for each corresponding ejector 600. Specifically, the shift registers 222 having the number of stages corresponding to the ejector 600 are coupled in cascade, and the print data signal SIj serially supplied is sequentially transferred to the subsequent stage according to the clock signal SCKj. Then, by stopping the supply of the clock signal SCKj, each shift register 222 holds the 2-bit print data [SIH, SIL] corresponding to the ejector 600. In FIG. 6, in order to distinguish the shift registers 222, a 1-stage, a 2-stage, . . . , a 2m-stage are sequentially illustrated from the upstream to which the print data signal SIj is supplied.

Each of the 2m latch circuits 224 latches the print data [SIH, SIL] held in the corresponding shift register 222 at the rise of the latch signal LATj. Each of the 2m decoders 226 decodes the 2-bit print data [SIH, SIL] latched by the corresponding latch circuit 224 to generate a selection signal S, and supplies the same to the selection circuit 230.

The selection circuits 230 are provided corresponding to the respective ejectors 600. That is, the number of the selection circuits 230 included in the print head 35-*j* is the same as that of the 2m ejectors 600 included in the print head 35-*j*. Then, the selection circuit 230 controls the supply of the drive signal COMj to the piezoelectric element 60 based on the selection signal S supplied from the decoder 226.

Figures 7, 8:
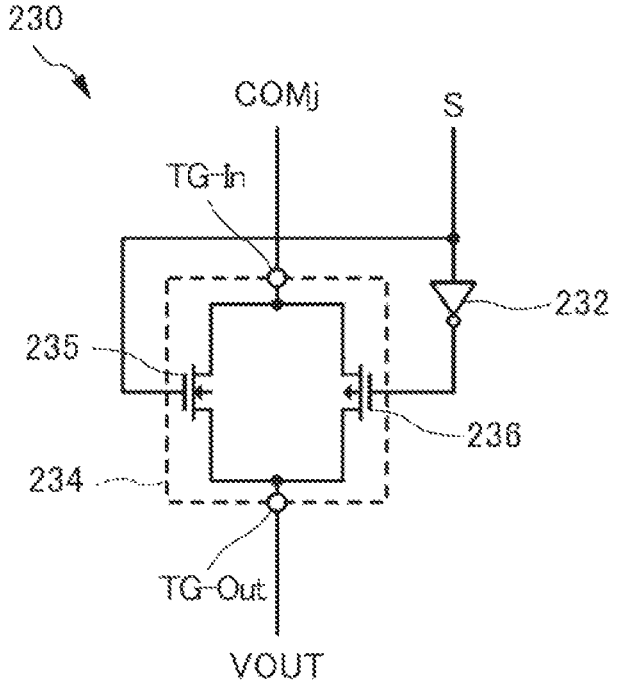
FIG. 7 is a view illustrating an electrical configuration of a selection circuit corresponding to one ejector.
FIG. 8 is a view illustrating an example of decoding contents in a decoder.

FIG. 7 is a view illustrating an electrical configuration of the selection circuit 230 corresponding to one ejector 600. As illustrated in FIG. 7, the selection circuit 230 includes an inverter 232 and a transfer gate 234. In addition, the transfer gate 234 includes a transistor 235 that is an NMOS transistor and a transistor 236 that is a PMOS transistor.

The selection signal S is supplied from the decoder 226 to the gate terminal of the transistor 235. The selection signal S is logically inverted by the inverter 232 and is also supplied to the gate terminal of the transistor 236. The drain terminal of the transistor 235 and the source terminal of the transistor 236 are coupled to a terminal TG-In of the transfer gate 234. The drive signal COMj is input to the terminal TG-In of the transfer gate 234. That is, the terminal TG-In of the transfer gate 234 is electrically coupled to the drive signal output circuit 50-*j*. The transistors 235 and 236 are controlled to be turned on or off according to the selection signal S so that the drive signal VOUT is output from the terminal TG-Out of the transfer gate 234 in which the source terminal of the transistor 235 and the drain terminal of the transistor 236 are commonly coupled. The terminal TG-Out of the transfer gate 234 to which the drive signal VOUT is output is electrically coupled to the piezoelectric element 60.

Next, the decoding contents of the decoder 226 will be described with reference to FIG. 8. FIG. 8 is a view illustrating an example of decoding contents in the decoder 226. The 2-bit print data [SIH, SIL], the latch signal LATj, and the change signal CHj are input to the decoder 226. Then, for example, when the print data [SIH, SIL] is [1, 0] that defines "medium dot", the decoder 226 outputs the selection signal S which becomes H, L, L level in the periods T1, T2, T3. Here, the logic level of the selection signal S is level-shifted to a high-amplitude logic based on the voltage VHV by a level shifter (not illustrated).

Figure 9:
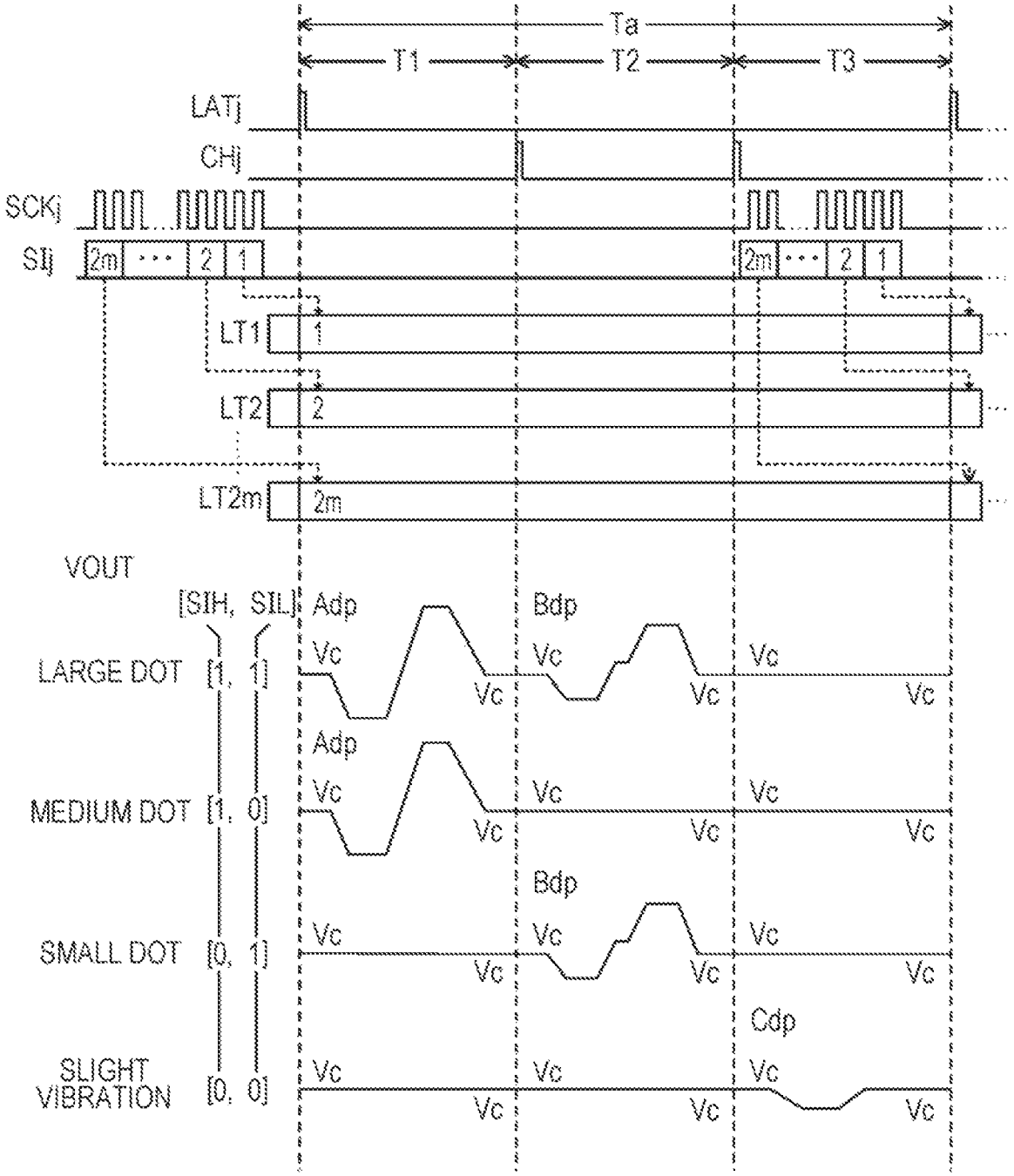
FIG. 9 is a view illustrating an operation of the drive signal selection control circuit.

FIG. 9 is a view for explaining the operation of the drive signal selection control circuit 200 included in the print head 35-*j*. As illustrated in FIG. 9, the print data [SIH, SIL] included in the print data signal SIj is serially supplied to the drive signal selection control circuit 200 in synchronization with a clock signal SCKj and is sequentially transferred in the shift register 222 corresponding to the ejector 600. Then, when the supply of the clock signal SCKj is stopped, the print data [SIH, SIL] corresponding to the ejector 600 is held in each of the shift registers 222. The print data signal SIj is supplied in the order corresponding to the final 2m-stage, . . . , 2-stage and 1-stage of the ejector 600 in the shift register 222.

When the latch signal LATj rises, each of the latch circuits 224 simultaneously latches the print data [SIH, SIL] held in the corresponding shift register 222. LT1, LT2, . . . , LT2*m* illustrated in FIG. 9 represent print data [SIH, SIL] latched by the latch circuit 224 corresponding to the 1-stage, 2-stage, . . . , 2m-stage shift registers 222.

The decoder 226 outputs a selection signal S having a logic level according to the contents illustrated in FIG. 8 in each of the periods T1, T2, and T3 in accordance with the dot size defined by the latched print data [SIH, SIL].

When the print data [SIH, SIL] is [1, 1], according to the selection signal S, the selection circuit 230 selects the trapezoidal waveform Adp in the period T1, selects the trapezoidal waveform Bdp in the period T2, and does not select the trapezoidal waveform Cdp in the period T3. As a result, the drive signal VOUT corresponding to a large dot illustrated in FIG. 9 is generated. Therefore, a medium amount of ink and a small amount of ink are ejected from the corresponding ejector 600 of the print head 35-*j*. Then, by combining the ink on the medium P, a large dot is formed on the medium P. Further, when the print data [SIH, SIL] is [1, 0], according to the selection signal S, the selection circuit 230 selects the trapezoidal waveform Adp in the period T1, does not select the trapezoidal waveform Bdp in the period T2, and does not select the trapezoidal waveform Cdp in the period T3. As a result, the drive signal VOUT corresponding to a medium dot illustrated in FIG. 9 is generated. Therefore, a medium amount of ink is ejected from the corresponding ejector 600 of the print head 35-*j*. Therefore, medium dots are formed on the medium P. Further, when the print data [SIH, SIL] is [0, 1], according to the selection signal S, the selection circuit 230 does not select the trapezoidal waveform Adp in the period T1, selects the trapezoidal waveform Bdp in the period T2, and does not select the trapezoidal waveform Cdp in the period T3. As a result, the drive signal VOUT corresponding to a small dot illustrated in FIG. 9 is generated. Therefore, a small amount of ink is ejected from the corresponding ejector 600 of the print head 35-*j*. Therefore, a small dot is formed on the medium P. Further, when the print data [SIH, SIL] is [0, 0], according to the selection signal S, the selection circuit 230 does not select the trapezoidal waveform Adp in the period T1, dose not select the trapezoidal waveform Bdp in the period T2, and selects the trapezoidal waveform Cdp in the period T3. As a result, the drive signal VOUT corresponding to the slight vibration illustrated in FIG. 9 is generated. Therefore, ink is not ejected from the corresponding ejector 600 of the print head 35-*j*, and a slight vibration occurs.

4.3. Configuration of Restoration Circuit

Next, the configuration and operation of the restoration circuit 210 integrated in the integrated circuit 362 of the print head 35-*j* will be described.

Figure 10:
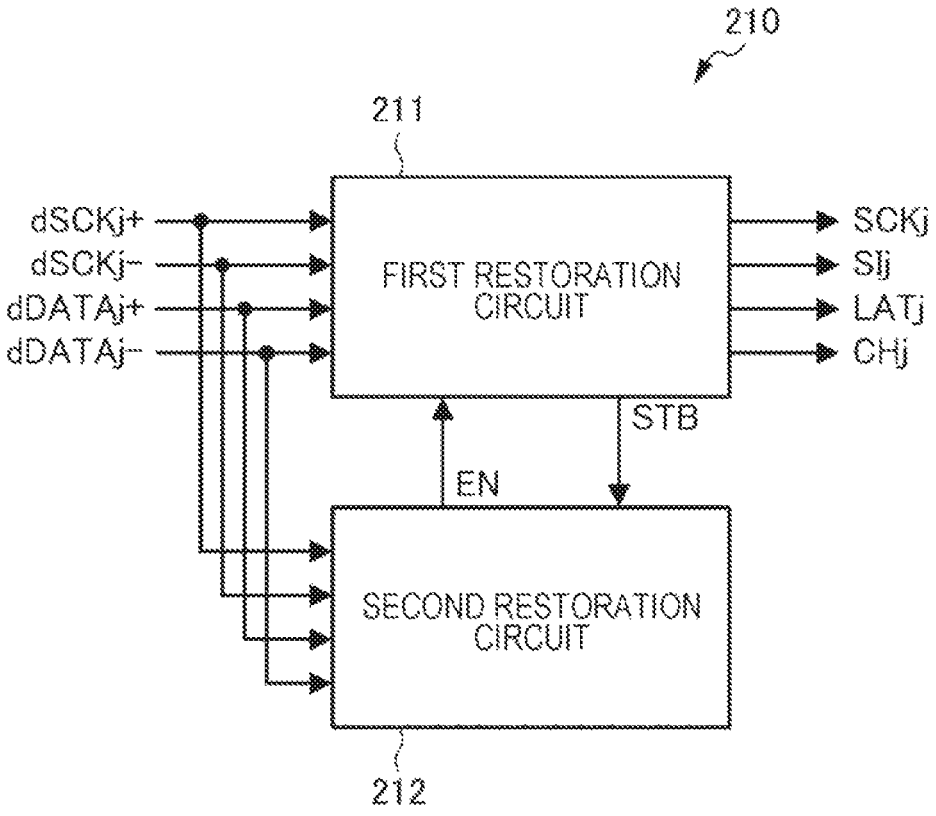
FIG. 10 is a view illustrating a configuration of a restoration circuit.

FIG. 10 is a view illustrating the configuration of the restoration circuit 210. As illustrated in FIG. 10, the restoration circuit 210 included in the print head 35-*j* includes a first restoration circuit 211 electrically coupled to the wirings 145*a-j* and 145*b-j*, and a second restoration circuit 212 which is electrically coupled to the wirings 145*a-j* and 145*b-j* and consumes less power than the first restoration circuit 211. Then, the first restoration circuit 211 included in the restoration circuit 210 outputs the clock signal SCKj, the print data signal SIj, the latch signal LATj, and the change signal CHj for controlling the driving of the piezoelectric element 60 based on the pair of differential data signals dDATAj and the pair of differential clock signals dSCKj input via the wirings 145*a-j* and 145*b-j*.

Further, the first restoration circuit 211 outputs a standby signal STB to the second restoration circuit 212, and the second restoration circuit 212 outputs an enable signal EN to the first restoration circuit 211. That is, the first restoration circuit 211 and the second restoration circuit 212 are electrically coupled to each other by the wiring through which at least one of the standby signal STB and the enable signal EN propagates. The standby signal STB and the enable signal EN may be propagated through a common wiring or different wirings.

Here, since the first restoration circuit 211 outputs the clock signal SCKj, the print data signal SIj, the latch signal LATj, and the change signal CHj for controlling the driving of the piezoelectric element 60 based on the pair of differential data signals dDATAj and the pair of differential clock signals dSCKj, the power consumption of the first restoration circuit 211 is larger than the power consumption of the second restoration circuit 212 because the operating frequency of the first restoration circuit is higher than the operating frequency of the second restoration circuit 212, the current value of the signal output from the first restoration circuit is larger than the current value of the signal output from the second restoration circuit 212, and the voltage value of the signal output from the first restoration circuit is larger than the voltage value of the signal output from the second restoration circuit 212.

Further, since the power consumption of the first restoration circuit 211 is larger than the power consumption of the second restoration circuit 212, it is preferable that the mounting area in which the circuit constituting the first restoration circuit 211 is mounted is larger than the mounting area in which the circuit constituting the second restoration circuit 212 is mounted. By making the mounting area of the first restoration circuit 211 with large power consumption larger than the mounting area of the second restoration circuit 212 with small power consumption, in addition to being able to increase the voltage and current resistance of the first restoration circuit 211, it is possible to improve the heat dissipation of the first restoration circuit 211. As a result, the operation of the restoration circuit 210 can be stabilized.

Here, the first restoration circuit 211 is an example of the first receiving circuit, and the second restoration circuit 212 is an example of the second receiving circuit. The wiring which electrically couples the first restoration circuit 211 and the second restoration circuit 212, and through which at least one of the standby signal STB and the enable signal EN propagates is an example of the second signal wiring.

As illustrated in FIG. 10, the pair of differential clock signals dSCKj and the pair of differential data signals dDATAj output from the conversion circuit 140-*j* are input to the first restoration circuit 211 included in the print head 35-*j*. Then, the first restoration circuit 211 generates a clock signal SCKj, a print data signal SIj, a latch signal LATj, and a change signal CHj which are input to the drive signal selection control circuit 200, based on the pair of differential clock signals dSCKj and the pair of differential data signals dDATAj to be input, and outputs the same to the corresponding drive signal selection control circuit 200. Further, the first restoration circuit 211 outputs the standby signal STB to the second restoration circuit 212 based on the pair of differential clock signals dSCKj and the pair of differential data signals dDATAj to be input.

The enable signal EN is input to the first restoration circuit 211 from the second restoration circuit 212. Based on the logic level of the enable signal EN to be input, the first restoration circuit 211 is controlled whether to be in a drive state in which the clock signal SCKj, the print data signal SIj, the latch signal LATj, and the change signal CHj to be input to the drive signal selection control circuit 200 are generated and output, based on the pair of differential clock signals dSCKj and the pair of differential data signals dDATAj to be input, or in a sleep state in which the operation is stopped.

Here, the first restoration circuit 211 being in the sleep state means a state in which the first restoration circuit 211 has stopped operating and consumes less power than that in the drive state, and includes for example, a state in which the output of the clock signal SCKj, the print data signal SIj, the latch signal LATj, and the change signal CHj is stopped, the input of the pair of differential clock signals dSCKj and the pair of differential data signals dDATAj is invalid, further, a state in which no voltage is supplied to various circuits constituting the first restoration circuit 211, and the like.

The pair of differential clock signals dSCKj and the pair of differential data signals dDATAj output from the conversion circuit 140-*j* are input to the second restoration circuit 212. Then, the second restoration circuit 212 generates an enable signal EN according to the pair of differential clock signals dSCKj and the pair of differential data signals dDATAj to be input and outputs the same to the first restoration circuit 211. Further, the second restoration circuit 212 generates an enable signal EN according to the standby signal STB input from the first restoration circuit 211 and outputs the same to the first restoration circuit 211.

Further, the second restoration circuit 212 switches between the drive state and the sleep state according to the logic level of the standby signal STB input from the first restoration circuit 211. Here, the second restoration circuit 212 being in the drive state means a state in which the enable signal EN can be output according to the input of the pair of differential clock signals dSCKj and the pair of differential data signals dDATAj, and the second restoration circuit 212 being in the sleep state means a state in which the power consumption is smaller than that in the drive state, and includes, for example, a state in which the input of the pair of differential clock signals dSCKj and the pair of differential data signals dDATAj is invalid, and a state in which no voltage is supplied to various circuits constituting the second restoration circuit 212.

Figure 11:
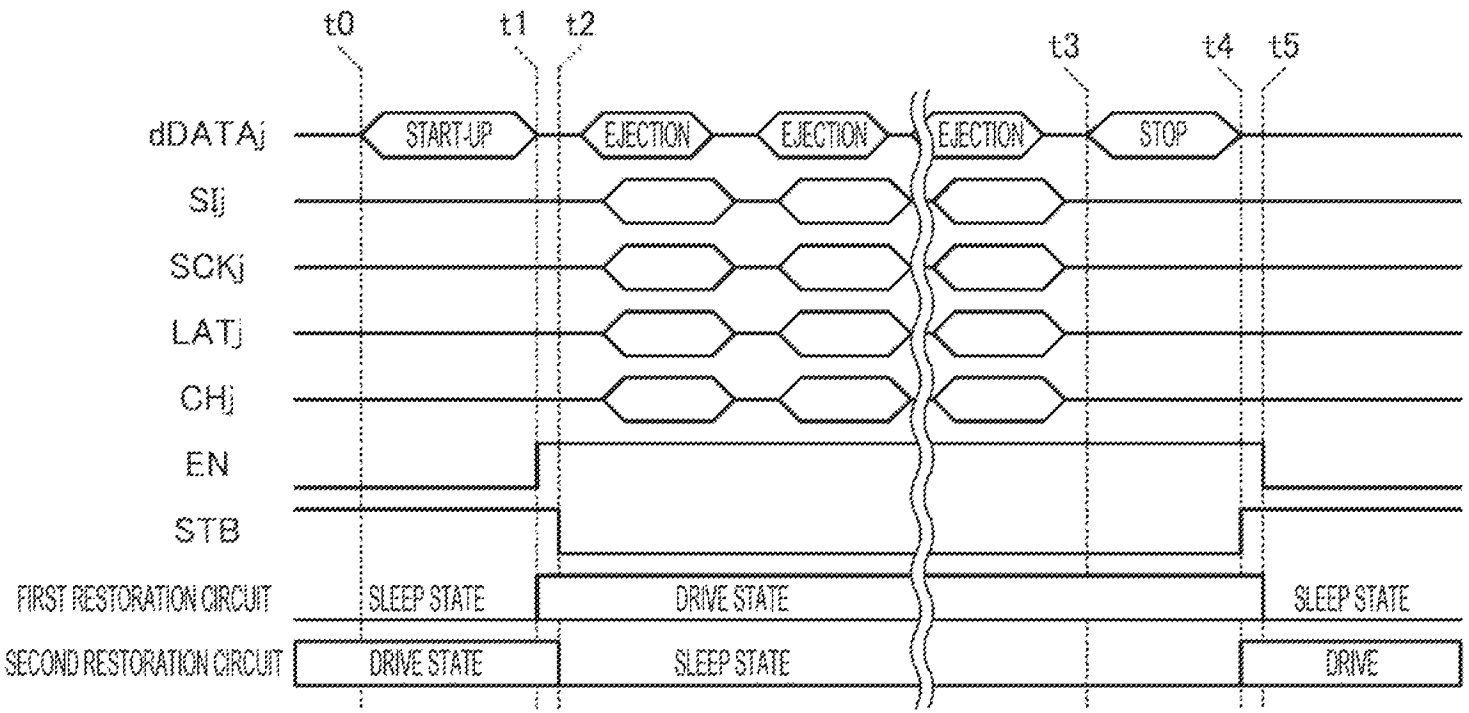
FIG. 11 is a view illustrating an operation of the restoration circuit.

Here, the operation of the restoration circuit 210 will be described with reference to FIG. 11. FIG. 11 is a view illustrating the operation of the restoration circuit 210. Here, in the description of FIG. 11, the first restoration circuit 211 will be described as being in a drive state when the enable signal EN is at a H-level and being in a sleep state when the enable signal EN is at a L-level. Further, it is assumed that the first restoration circuit 211 outputs a H-level standby signal STB in the drive state and outputs a L-level standby signal STB in the sleep state. The second restoration circuit 212 will be described as being in a drive state when the standby signal STB is at the H-level and being in a sleep state when the standby signal STB is at the L-level. The relationship between the logic levels of the enable signal EN and the standby signal STB and the operation of the first restoration circuit 211 and the second restoration circuit 212 is not limited to the above-described relationship, and for example, the logic levels of the enable signal EN and the standby signal STB when each of the first restoration circuit 211 and the second restoration circuit 212 is in the drive state or the sleep state may be inverted from the contents described above.

As illustrated in FIG. 11, before a time to, an L-level enable signal EN is input to the first restoration circuit 211. Therefore, before the time t0, the first restoration circuit 211 is controlled to be in the sleep state. Then, at the time t0, a start-up command for putting the first restoration circuit 211 into the drive state is input to the restoration circuit 210. In this case, the first restoration circuit 211 cannot recognize the start-up command because the first restoration circuit 211 is in the sleep state. In other words, the start-up command is recognized only by the second restoration circuit 212. Then, at a time t1 when the start-up command is recognized by the second restoration circuit 212, the second restoration circuit 212 outputs a H-level enable signal EN. As a result, the first restoration circuit 211 is in the drive state. Then, the first restoration circuit 211 outputs the L-level standby signal STB to the second restoration circuit 212 at a time t2 after the drive state. As a result, the second restoration circuit 212 enters the sleep state.

Further, at the time t1, by putting the first restoration circuit 211 into the drive state, the first restoration circuit 211 generates the clock signal SCKj, the print data signal SIj, the latch signal LATj, and the change signal CHj according to the pair of differential clock signals dSCKj and the pair of differential data signals dDATAj to be input from the conversion circuit 140-*j*, and outputs the same to the print head 35-*j*. As a result, a predetermined amount of ink is ejected from the nozzle 651 of the print head 35-*j* at a predetermined timing. In this case, since the second restoration circuit 212 is in the sleep state, the second restoration circuit 212 does not recognize the pair of differential clock signals dSCKj and the pair of differential data signals dDATAj input from the conversion circuit 140-*j*.

In the liquid ejecting apparatus 1, at a time t3 when the series of printing processing is completed, the stop command for putting the first restoration circuit 211 into the sleep state is input to the restoration circuit 210. In this case, the second restoration circuit 212 does not recognize the stop command because the second restoration circuit 212 is in the sleep state. In other words, the stop command is recognized only by the first restoration circuit 211. Then, at a time t4 when the stop command is recognized by the first restoration circuit 211, the first restoration circuit 211 outputs the H-level standby signal STB to the second restoration circuit 212. As a result, the second restoration circuit 212 is in the drive state. Then, the second restoration circuit 212 outputs the L-level enable signal EN to the first restoration circuit 211 at a time t5 after the drive state. As a result, the first restoration circuit 211 enters the sleep state. The state of the restoration circuit 210 at the time t5 is the same as the state of the restoration circuit 210 before the time t0 illustrated in FIG. 11. That is, the restoration circuit 210 repeats the same operation thereafter.

As described above, in the restoration circuit 210 in the present embodiment, when the piezoelectric element 60 included in the print head 35-*j* is driven, that is, when the clock signal SCKj, the print data signal SIj, the latch signal LATj, and the change signal CHj are output from the restoration circuit 210, the first restoration circuit 211 operates. On the other hand, in the restoration circuit 210 of the present embodiment, when the piezoelectric element 60 included in the print head 35-*j* is not driven, that is, the clock signal SCKj, the print data signal SIj, the latch signal LATj, and the change signal CHj are not output from the restoration circuit 210, the second restoration circuit 212 operates, and the first restoration circuit 211 stops operating.

By controlling the first restoration circuit 211 and the second restoration circuit 212 included in the restoration circuit 210 as described above, when the pair of differential clock signals dSCKj and the pair of differential data signals dDATAj output from the conversion circuit 140-*j* are not input to the restoration circuit 210, that is, when the clock signal SCKj, the print data signal SIj, the latch signal LATj, and the change signal CHj are not output from the restoration circuit 210, it is possible to put the first restoration circuit 211 in the sleep state. As a result, it is possible to reduce the power consumption of the integrated circuit 362 including the restoration circuit 210, the drive circuit 51, and the liquid ejecting apparatus 1.

5. Operational Effects

As described above, in the liquid ejecting apparatus 1, the drive circuit 51, and the integrated circuit 362 in the present embodiment, the restoration circuit 210 included in the print head 35-*j* that restores the pair of differential clock signals dSCKj and the pair of differential data signals dDATAj to be input includes the first restoration circuit 211 that generates and outputs a clock signal SCKj, a print data signal SIj, a latch signal LATj, and a change signal CHj for controlling the driving of the piezoelectric element 60 based on the pair of differential clock signals dSCKj and the pair of differential data signals dDATAj to be input, and the second restoration circuit that consumes less power than the first restoration circuit 211. Then, the first restoration circuit 211 and the second restoration circuit are electrically coupled to each other by the wiring through which the standby signal STB and the enable signal EN propagate.

As a result, the first restoration circuit 211 and the second restoration circuit 212 can control the operating states of each other. Therefore, when the first restoration circuit 211 generates and outputs the clock signal SCKj, the print data signal SIj, the latch signal LATj, and the change signal CHj for controlling the driving of the piezoelectric element 60 based on the input pair of differential clock signals dSCKj and the pair of differential data signals dDATAj to be input, the first restoration circuit 211 can be controlled so that the operation of the second restoration circuit 212 with low power consumption is stopped, and when the first restoration circuit 211 does not generate the clock signal SCKj, the print data signal SIj, and the latch signal LATj, and the change signal CHj for controlling the driving of the piezoelectric element 60 based on the pair of differential clock signals dSCKj and the pair of differential data signals dDATAj to be input, the second restoration circuit 212 can be controlled so that the operation of the first restoration circuit 211 with large power consumption is stopped.

As a result, when the first restoration circuit 211 does not generate the clock signal SCKj, the print data signal SIj, the latch signal LATj, and the change signal CHj for controlling the driving of the piezoelectric element 60 based on the pair of differential clock signals dSCKj and the pair of differential data signals dDATAj to be input, it is possible to reduce the power consumption of the liquid ejecting apparatus 1 and the drive circuit 51.

Therefore, in the liquid ejecting apparatus 1, the drive circuit 51, and the integrated circuit 362 in the present embodiment, in the liquid ejecting apparatus 1, the drive circuit 51, and the integrated circuit 362, which use a differential signal to propagate data at high speed as the amount of data increases, both high-speed transmission of signals by the differential signal and reduction of power consumption of the liquid ejecting apparatus 1, the drive circuit 51, and the integrated circuit 362 can be achieved.

As described above, although the embodiments were described, the disclosure is not limited to these embodiments and can be implemented in various modes without departing from the scope of the disclosure. For example, the above embodiments can be appropriately combined.

The present disclosure includes substantially the same configuration as the configuration described in the embodiment (for example, a configuration having the same function, method, and result, or a configuration having the same object and effect). In addition, the present disclosure includes a configuration in which non-essential parts of the configuration described in the embodiment are replaced. In addition, the present disclosure includes a configuration that exhibits the same operational effects as the configuration described in the embodiment or a configuration that can achieve the same object. In addition, the present disclosure includes a configuration in which a known technique is added to the configuration described in the embodiment.

What is claimed is:

1. A liquid ejecting apparatus comprising:

a differential signal output circuit that outputs a pair of differential signals based on an original control signal;

a pair of first signal wirings that are electrically coupled to the differential signal output circuit and propagate the differential signals;

a first receiving circuit that is electrically coupled to the first signal wirings;

a second receiving circuit that is electrically coupled to the first signal wirings; and an ejector that includes a drive element and that ejects a liquid from a nozzle by driving the drive element, wherein the first receiving circuit outputs a control signal for controlling driving of the drive element based on the differential signals, power consumption of the first receiving circuit is larger than power consumption of the second receiving circuit, and the first receiving circuit and the second receiving circuit are electrically coupled by a second signal wiring.

2. The liquid ejecting apparatus according to claim 1, wherein an operating frequency of the first receiving circuit is higher than an operating frequency of the second receiving circuit.

3. The liquid ejecting apparatus according to claim 1, wherein a mounting area in which the first receiving circuit is mounted is larger than a mounting area in which the second receiving circuit is mounted.

4. The liquid ejecting apparatus according to claim 1, wherein the first receiving circuit operates, when the drive element is driven.

5. The liquid ejecting apparatus according to claim 1, wherein the second receiving circuit operates, when the drive element is not driven.

6. The liquid ejecting apparatus according to claim 1, wherein the first receiving circuit stops operating, when the drive element is not driven.

7. The liquid ejecting apparatus according to claim 1, further comprising:

a drive signal output circuit that outputs a drive signal for driving the drive element; and a drive signal supply control circuit that controls supply of the drive signal to the drive element based on the control signal, wherein the first receiving circuit, the second receiving circuit, and the drive signal supply control circuit are integrated in one integrated circuit.

8. The liquid ejecting apparatus according to claim 1, further comprising:

an ejecting head having a plurality of ejectors, wherein the ejecting head is provided with a plurality of the nozzles corresponding to the plurality of ejectors in a total of 600 nozzles or more at a density of 300 nozzles or more per inch.

9. A drive circuit that drives a drive element for ejecting a liquid from an ejector, the drive circuit comprising:

a differential signal output circuit that converts an original control signal into a pair of differential signals and outputs the pair of differential signals;

a pair of first signal wirings that are electrically coupled to the differential signal output circuit and propagate the differential signals;

a first receiving circuit that is electrically coupled to the first signal wirings; and a second receiving circuit that is electrically coupled to the first signal wirings, wherein the first receiving circuit outputs a control signal for controlling driving of the drive element based on the differential signals, power consumption of the first receiving circuit is larger than power consumption of the second receiving circuit, and the first receiving circuit and the second receiving circuit are electrically coupled by a second signal wiring.

10. An integrated circuit that drives a drive element for ejecting a liquid from an ejector, the integrated circuit comprising:

a pair of input terminals to which a pair of differential signals are input;

a first receiving circuit that is electrically coupled to the input terminal; and a second receiving circuit that is electrically coupled to the input terminal, wherein the first receiving circuit outputs a control signal for controlling driving of the drive element based on the differential signals, power consumption of the first receiving circuit is larger than power consumption of the second receiving circuit, and the first receiving circuit and the second receiving circuit are electrically coupled by a second signal wiring.

* * * * *